United States Patent [19]

Eheim et al.

[11] 3,942,498

[45] Mar. 9, 1976

[54] REGULATOR FOR A FUEL INJECTION PUMP

[75] Inventors: Franz Eheim; Wolfgang Fehlmann, both of Stuttgart, Germany

[73] Assignee: Robert Bosch GmbH, Stuttgart, Germany

[22] Filed: July 16, 1974

[21] Appl. No.: 488,954

[30] Foreign Application Priority Data

July 17, 1974 Germany ..... 2336194

[52] U.S. Cl.... 123/140 R; 123/140 MC; 123/179 L

[51] Int. Cl.[2] ..... F02D 1/00

[58] Field of Search..... 123/140 R, 179 L, 139 BD, 123/140 MC

[56] References Cited

UNITED STATES PATENTS

| | | | |
|---|---|---|---|
| 3,547,092 | 2/1969 | Knight | 123/140 FG |
| 3,638,631 | 1/1972 | Eheim | 123/179 L |
| 3,848,576 | 11/1974 | Hofer | 123/139 BD |

*Primary Examiner*—Wendell E. Burns
*Assistant Examiner*—James Winthrop Cranson, Jr.
*Attorney, Agent, or Firm*—Edwin E. Greigg

[57] ABSTRACT

An improved r.p.m. regulator of a fuel injection pump for internal combustion engines includes an improved control spring mechanism. The control spring mechanism is connected to one end of a control lever which in turn is connected at its other end to a fuel supply quantity setting member. The control lever serves to actuate the fuel supply quantity setting member in accordance with the forces applied to the control lever by the control spring mechanism and an r.p.m.-dependent force applying structure which applies a force to the control lever in opposition to the force applied by the control spring mechanism. The control spring mechanism includes a compression spring mounted between the control lever and a setting lever, a first connecting member and a second connecting member. The first connecting member is connected to that end of the control spring furthest from the setting lever, while the second connecting member is connected to that end of the control spring furthest from the control lever.

9 Claims, 6 Drawing Figures

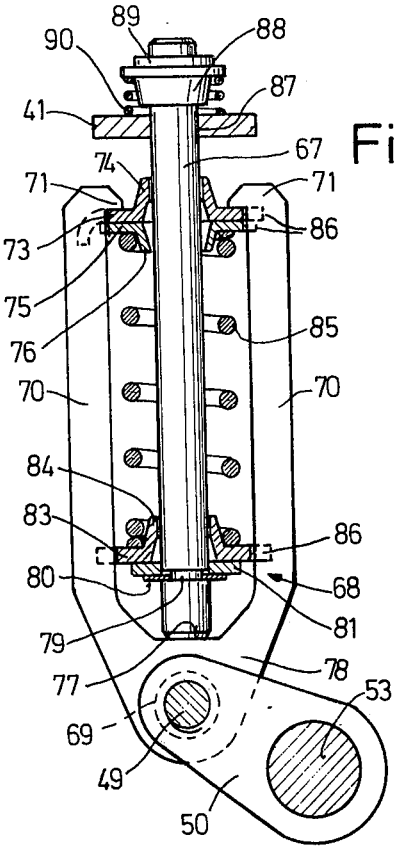
Fig.2
Fig.3
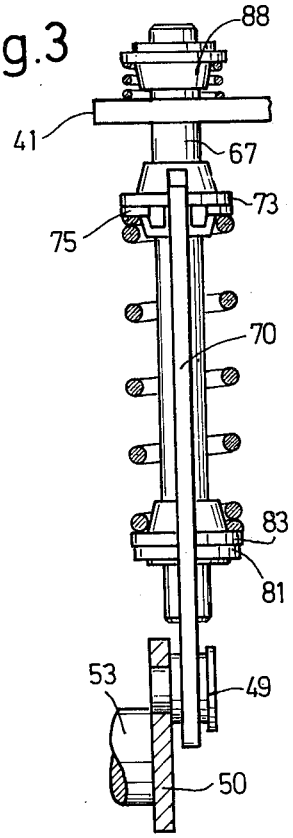
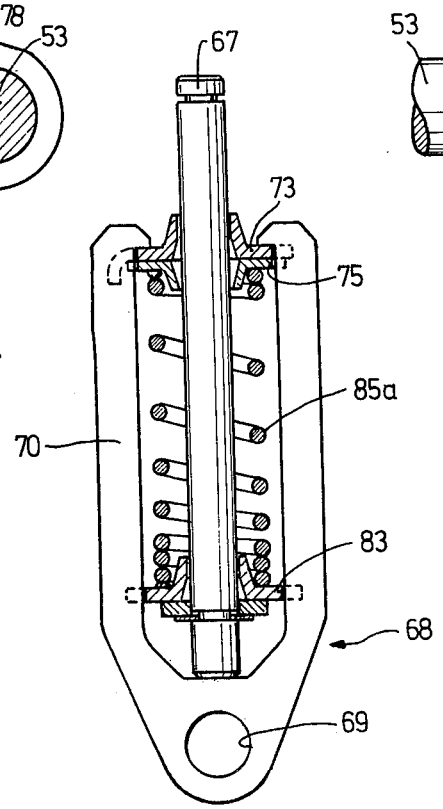
Fig.4

REGULATOR FOR A FUEL INJECTION PUMP

BACKGROUND OF THE INVENTION

The present invention relates to an r.p.m. regulator of a fuel injection pump for internal combustion engines, and more particularly to an r.p.m. regulator of a fuel injection pump including a pivotably mounted control lever intended to actuate a fuel quantity setting member of the fuel injection pump and engaged by a control spring system including a preloaded control spring disposed between a setting lever and a control lever and acting in opposition to an r.p.m. dependent force in the tensile direction.

In a known regulator of this type, a tensile spring is suspended by a loop at one of its ends from a first connecting member between the setting lever and the control lever and by a loop at its other end from a second connecting member between the setting and control levers. In this arrangement the second connecting member is pressed by the tensile spring onto the head of a screw screwed into the first connecting member. The pretension of the spring is determined by the depth to which the screw is screwed in. This arrangement has a disadvantage in that the spring loops could be displaced with respect to their suspension points which can result in the change of the preset preload during operation of the device. Furthermore, it is possible that during the operation, the screw could be further screwed into the first connecting member so that, for this reason, the desired and preset preload could not be maintained with certainty over a long period of time. Still further, high contact pressure results at the contact points of the loops and the connecting members resulting in high wear. Then too, this system is not stable with respect to lateral forces and with respect to buckling and, in addition, when the regulator shuts off and the second connecting member is lifted from the head of the screw, the first connecting member may oscillate.

OBJECT AND SUMMARY OF THE INVENTION

It is, therefore, an object of the present invention to provide a regulator of the above type which avoids the disadvantages cited.

This object is accomplished according to the present invention due to the fact that the control spring is a compression spring and due to the fact that the connecting members associated with the setting lever and the control lever, respectively, engage the spring at the far ends of the spring with respect to these levers.

An advantageous embodiment of the present invention consists of a control spring mounted coaxially with and symmetrically enveloping an actuating rod serving as one of the connecting members and between one end thereof and the end of a bracket serving as the second of the connecting members. The control spring engages the actuating rod in the direction of a stop near one of its ends and in the middle portion of the bracket. The bracket is preferably formed as a pressed metal part.

The coaxial disposition of the control spring results in a uniform axial loading of the actuating rod and the bracket. Furthermore, the bracket can be made very advantageously as a pressed sheet metal part.

In this way, the compression spring is mounted without friction between the actuating rod and the bracket and is not affected by any lateral forces. In addition, the spring supports provide a sufficiently large surface for the transmission of forces.

Another embodiment, according to the present invention, consists in that each of the spring supports is provided with diametrically opposed recesses which are engaged by the arms of the bracket.

In this way, the spring supports are exactly guided so that any lateral forces could not cause buckling or shifting of the connecting members with respect to one another.

A further advantageous embodiment of the present invention consists in that, between the second spring support and the safety ring there is disposed a spacer disc. This makes possible a secure and immutable desired preload of the compression spring. The spacer disc can easily be replaced if a correction should become necessary.

A still further advantageous embodiment of the present invention consists in that the compression spring is a progressive compression spring, and further in that the progressive compression spring consists of at least two sequentially disposed compression springs with different spring characteristics between which there is disposed an intermediate spring support guided by the actuating rod. The use of a progressive compression spring as a control spring makes possible an advantageous adaptation of the diminishing control characteristics of the injection pump to the requirements of the associated internal combustion engine. Several exemplary embodiments of the objects of the present invention are shown in the drawing and are described further below.

BRIEF DESCRIPTION OF THE DRAWING

FIG. 2 is a detailed view of a first exemplary embodiment of the control spring mechanism according to the present invention;

FIG. 3 is a view of the first exemplary embodiment of FIG. 2 rotated by 90°;

FIG. 4 is a second exemplary embodiment of the control spring mechanism according to the present invention in its essential parts;

DESCRIPTION OF THE PREFERRED EMBODIMENT

Figure 1:
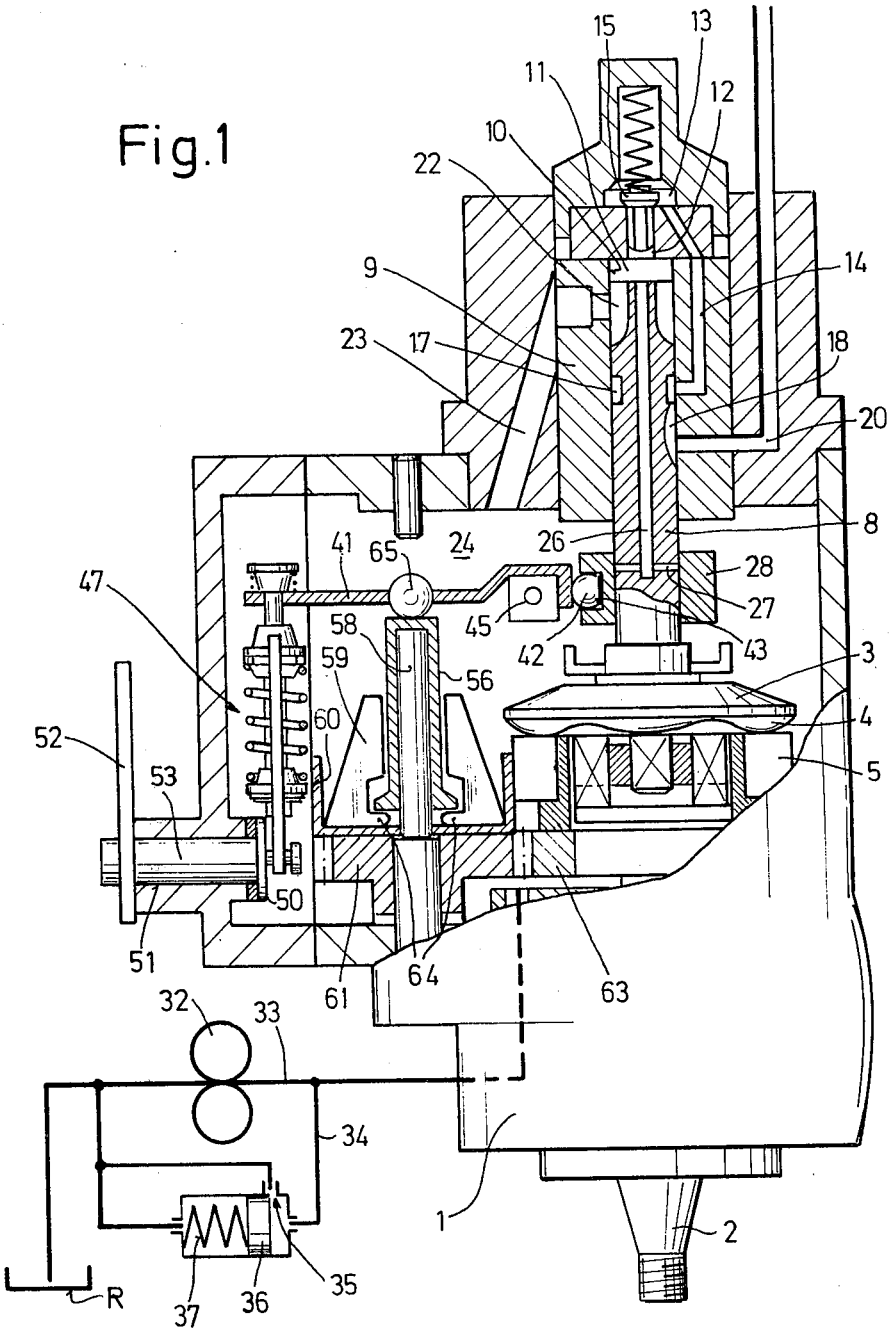
FIG. 1 is a partial section through a fuel injection pump with a single reciprocating and simultaneously rotating pump piston which also serves as a distributor and including the governor mechanism according to the present invention.

The disposition of parts and the method of operation of the regulator according to the present invention is described below using the example of a distribution pump of known construction. A housing 1 of a fuel injection pump for multi-cylinder internal combustion engines contains a drive shaft 2. This drive shaft 2 is coupled to a frontal cam plate 3 which has as many cams 4 as the number of cylinders of the associated internal combustion engine. The cam plate 3 is moved by locally fixed rollers 5 and by the rotation of the drive shaft 2. This motion results in a reciprocating and simultaneously rotating motion of a pump piston 8 coupled with the frontal cam plate 3 and pressed onto the cam plate 3 by a spring (not shown). The pump piston 8 is displaceable within a cylindrical bushing 9 which is closed on top and is inserted into the housing 1. The bushing 9 is provided with a cylinder bore 10 which encloses a working chamber 11. From the working chamber 11, an axial bore 12 communicates with a chamber 13 which, in turn, communicates through a line 14 with the bore 10 of the cylinder bushing 9. The axial bore 12 can be closed by a valve member 15 loaded in the direction of the working chamber 11. The connecting line 14 can be connected in sequence with pressure lines 20 terminating in the bore 10 through an annular groove 17 on the periphery of the pump piston 8 and through an axially oriented distributor groove 18 which is connected thereto. The pressure lines 20 are evenly distributed about the cylinder bore 10 and correspond to the number of cylinders of the internal combustion engine to be supplied with fuel. At each pressure stroke of the pump piston 8, fuel is delivered through the axial bore 12, the chamber 13, the connecting line 14 and the distributor groove 18 to one of the pressure lines 20. During the suction stroke, fuel flows from a suction chamber 24 through a supply line 23 terminating in the bore 10 and through one longitudinal groove 22 of a plurality of such grooves into the working chamber 11. The grooves 22 are equal in number to the number of cylinders of the engine and are similarly configured on the periphery of the pump piston. During the suction stroke of the pump piston 8, the rotation thereof interrupts the connection between the supply line 23 and the longitudinal grooves 22, so that the entire fuel quantity delivered by the pump piston can be supplied to the pressure lines.

For the purpose of regulating the delivered fuel quantity, the working chamber 11 can be connected with the pump suction chamber 24 through an axial blind bore 26 in the pump piston 8 and further through a transverse bore 27 intersecting the blind bore 26. Cooperating with the transverse bore 27 is a fuel quantity setting member 28 in the form of a sleeve slidable on the pump piston 8, where the position of the sleeve determines the point in time at which the upward motion of the pump piston 8 opens the transverse bore 27 and creates a connection between the working chamber 11 and the pump suction chamber 24. From this point on, the pump delivery is interrupted. Thus, the displacement of the sleeve 28 can be used to determine the quantity of fuel which is supplied for injection.

The supply of fuel to the pump working chamber is affected by a fuel pump 32 which aspirates fuel from a supply reservoir through a supply channel 33 into the suction chamber 24. In order to obtain an r.p.m.-dependent pressure, a by-pass of the fuel pump 32 contains a connecting line 34 with a throttle location 35. The size of the throttle opening can be changed by a piston 36 whose rear face is actuated by a spring 37 and also by the fuel pressure prevailing at the suction side of the pump, and whose front surface is actuated by the fuel pressure prevailing in the supply channel 33.

The change in the injected fuel quantity is effected by setting the sleeve 28 by means of a control lever 41 whose sperical head 42 engages a recess 43 within the sleeve 28. The control lever 41 is mounted on a shaft 45 serving as a fixed pivotal point. The position of this shaft can be changed by means which are not shown, for example, by an eccentric means in order to obtain a basic setting. Fastened to the extreme opposite end of the control lever 41 is a control spring mechanism 47 whose detailed construction is shown in FIGS. 2 and 3. The other end of the control spring mechanism connects via a connecting bolt 49 with a setting lever 50 which is rigidly mounted on an actuating shaft 53. The shaft 53 passes through a sealed bore 51. The shaft 53 can be externally rotated by a further lever 52, fixedly disposed thereon.

Located between the fastening point of the control spring mechanism 47 and the shaft 45 is the point of contact of a centrifugal force governor sleeve 56 which is slidingly displaced by fly weights 59 on a governor shaft 58. The fly weights 59 are located in sheet metal pockets 60 fixedly mounted on a gear 61 carried by the governor axis. The gear 61 is driven by a drive gear 63 rigidly connected with the drive shaft 2, and the fly weights 59 are driven by the sheet metal pockets 60 which, in turn, are driven by the gear 61. The fly weights 59 are moved radially outward corresponding to the r.p.m. and their protruding nose-shaped parts 64 lift the centrifugal force governor sleeve 56. Thus, when the governor sleeve 56 contacts the control lever 41, the r.p.m.-dependent centrifugal force is transmitted by lever action to the control lever and against the force of the control spring mechanism 47. In order to keep the distance between the point of contact of the centrifugal force transmitted by the governor sleeve and the shaft 45 constant at all times, this point contains a sphere 65 pressed into the control lever 41.

As soon as the clockwise moment provided by the centrifugal force exceeds the counterclockwise moment due to the control spring mechanism 47, the sleeve 28 is moved downwardly in a direction which reduces the fuel injection quantity. This process takes place until an equilibrium of forces again prevails at the control lever 41.

FIGS. 2 and 3 show in more detail the construction of a control spring mechanism in a first exemplary embodiment. The control spring mechanism consists primarily of two connected members between the control lever 41 and the setting lever 50, namely of an actuating rod 67 and a bracket 68. The lower end of the bracket 68 has a bore 69 penetrated by the connecting bolt 49. The arms 70 of the bracket 68 are largely parallel to the axis of the actuating rod 67 and have hook-shaped inwardly protruding ends 71. Abutting these ends is a a first spring support 73, whose interior portion 74 is hub-shaped and is penetrated by the actuating rod 67. In mirror image disposition to this first spring support 73, there is disposed a further spring support 75 which also has a hub-shaped interior portion 76. The actuating rod 67 is guided through the spring supports 73 and 75 and its face 77 at its lower end is supported by the middle portion 78 of the bracket 68. The lower end of the actuating rod 67 has an annular groove 79 which accepts a safety ring 80. Attaching to the safety ring 80 is a spacer disc 81 on which is mounted a second spring support 83. The spring support 83 has a hub-shaped inner portion 84, the same as spring supports 73 and 75, and is penetrated by the actuating rod 67. A compression spring 85 is compressed between spring supports 83 and 75. At the upper end, the actuating rod 67 penetrates a bore 87 within the control lever 41 and the end of the rod extending through the bore is equipped with a further spring support 88 which is itself supported on a safety ring 89 inserted in an annular groove of the actuating rod 67; compressed between it and the control lever 41 is an idling spring 90. The idling spring 90 may be compressed until the spring support 88 makes contact with the control lever 41.

Each of the spring supports 73, 75 and 83 is provided with two diametrically opposed recesses 86 which are engaged by the arms 70 of the bracket 68 and thus prevent the rotation of the spring supports. These recesses determine exactly the position of the actuating rod 67 with respect to the bracket 68 so that buckling is impossible. The actuating rod 67 is further guided positively by the two spring supports 73 and 75 including their hub-shaped inner portions 74 and 76.

The compression spring 85 presses the actuating rod 67 against the middle portion of the bracket 68 as long as the two ends of the control spring mechanism 47 experience forces that are smaller than that of the preloaded compression spring 85. However, if the external forces exceed the preload of the compression spring 85, then this spring is further compressed i.e., the actuating rod 67 lifts off from its stop. But even in the second phase the actuating rod is still exactly guided by the second spring support 83 with the recesses 86. The preload of the compression spring 85 can be varied within a certain range by the thickness of the spacer disc 81 and this is normally done only once during assembly. Subsequently, the mechanism holds the once set, desired preload of the compression spring securely and unchanged.

As long as the external forces acting on the control spring mechanism 47 (and which, for a fixedly set setting lever 50 correspond to the centrifugal forces transmitted to the control lever 41, with due consideration to the lever ratios,) are smaller than the force of the preloaded compression spring 85, the control spring mechanism 47 may be regarded as a rigid mechanism. In this region therefore, the displacement of the control lever 41 follows the displacement motion of the setting lever 50 which thus directly adjusts the injected fuel quantity. In this region, the governor operates as an idling-maximum r.p.m. governor.

During a further increase of the engine r.p.m. and a corresponding increase in the force on the centrigual force governor sleeve 56, the compression spring 85 is compressed so that even if the setting lever 50 is in a fixedly set position, the sleeve 28 is displaced in a direction so that the injected fuel quantity is reduced. Thus the governor controls downwardly in this region and according to a characteristic downward control behavior which is determined by the characteristics of the spring, the characteristic curves of the centrifugal force governor setting member and by the transmission lever ratio at the control lever 41.

Figure 5:
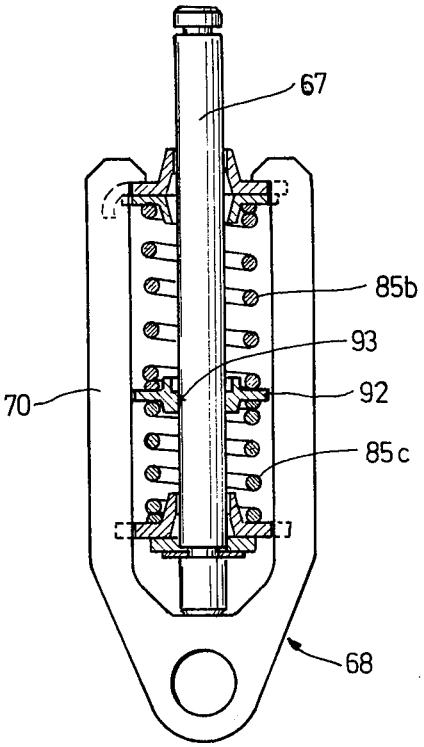
FIG. 5 is a third exemplary embodiment of the control spring mechanism according to the present invention in its essential parts.

The exemplary embodiments according to FIGS. 4 and 5 are essentially identical in construction to that of FIGS. 2 and 3. However, instead of the linear spring 85 provided in the exemplary embodiment according to FIG. 2, the spring **85*a* provided here is a progressive spring by means of which it is possible to adapt the downward control characteristics of the injection fuel pump more favorably to the requirements of the engine. The centrifugal force exerted by the fly weights 59 onto the centrifugal force governor sleeve 56 and exerted at a particular pivot point increases with r.p.m., and the force exerted by the compression spring of the control spring mechanism 47 onto control lever 41,** is independent of r.p.m. for a particular displacement thereof. A linear control spring would thus result in downward control curves which would be sharply different depending on the r.p.m. By the use of a progressive spring however, one can obtain downward control curves which deviate from one another in a less pronounced manner.

In the exemplary embodiment according to FIG. 5, the progressive compression spring **85*a* shown in the exemplary embodiment of FIG. 4 has been replaced by two compression springs 85*b* and 85*c* each of which has a linear characteristic, but having sharply different slopes. The two springs 85*b* and 85*c* are separated by an intermediate spring support 92 whose central bore 93 is penetrated by the actuating rod 67.**

This arrangement offers even better possibilities to adapt the control spring mechanism to the requirements of whatever engine is supplied by the injection pump.

Figure 6:
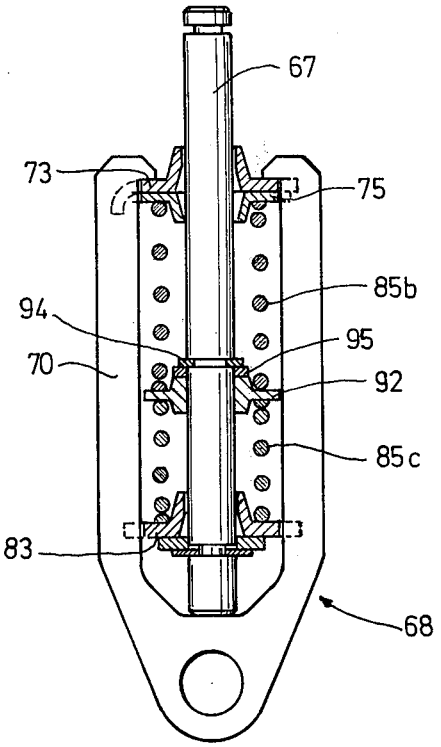
FIG. 6 is a fourth exemplary embodiment of the control spring mechanism according to the present invention with differently loaded springs.

The exemplary embodiment according to FIG. 6 shows a further possibility of graduating the resultant spring characteristic of a control spring mechanism including several springs. In this case, a safety ring 94 disposed on the control rod 67 forms a stop which together with a spacer disc 95 is disposed on that side of the intermediate spring support disc 92 which faces the spring support 73 and serves as a fixed stop for intermediate spring support 92; thus a desired preload of the lower compression spring **85*c*** may be adjusted.

Only when the force due to the compression of the upper compression spring **85*b* is greater than the preload of the compression spring 85*c*,** does this latter have any effect. Naturally, more than two springs with intermediate spring supports can be used if an even more finely differentiated tuning is desired wherein the springs would each be preloaded in the desired manner by appropriately disposed stops according to the above example and would only affect the control spring mechanism above a certain level of forces.

What is claimed is:

1. In an r.p.m. regulator of a fuel injection pump for internal combustion engines, including a fuel supply quantity setting member, a control spring mechanism having a preloaded control spring, a control lever connected to the control spring mechanism and to the fuel supply quantity setting member for actuating said fuel supply quantity setting member, said control lever being pivotably mounted between its connected ends, a setting lever, said control spring being connected to said setting lever and to said control lever thereby applying its preload to said control lever, and an r.p.m.-dependent force applying means engaging said control lever between its ends for applying thereto an r.p.m. dependent force in opposition to the force exerted by said control spring, the improvement comprising:

a. a first connecting member connected to said setting lever; and b. a second connecting member connected to said control lever, both said connecting members being part of said control spring mechanism, wherein said first connecting member is connected to that end of said control spring furthest from said setting lever and said second connecting member is connected to that end of said control spring furthest from said control lever, and wherein said control spring is a compression spring.

2. The r.p.m. regulator as defined in claim 1, wherein said first connecting member comprises a stamped metal bracket having a base portion at one end defining a central stop and a symmetrical pair of stops at its other end, wherein said second connecting member comprises an actuating rod, and wherein said control spring is mounted between said actuating rod and said bracket and coaxially with said actuating rod such that said control spring biases said actuating rod against said central stop.

3. The r.p.m. regulator as defined in claim 2, further comprising first and second spring supports and a safety ring mounted within an annular groove formed at one end of said actuating rod, wherein said bracket has a symmetrical pair of arms extending from the base portion and in a direction parallel to the direction of the axis of said actuating rod, said arms having said symmetrical pair of stops at their free ends which are configured as hook-shaped inwardly extending stops, wherein said first spring support includes an opening through which said actuating rod extends and engages said control spring on one side thereof and said symmetrical stops on the other side thereof, and wherein said second spring support engages said safety ring on one side thereof and said control spring on the other side thereof.

4. The r.p.m. regulator as defined in claim 3, wherein both said spring supports include diametrically opposite recesses for receiving thereto respective ones of said symmetrical arms.

5. The r.p.m. regulator as defined in claim 4, wherein said first spring support includes in assembly two parts which are arranged in mirror image relationship with each part defining a hub-shaped interior portion.

6. The r.p.m. regulator as defined in claim 4, further comprising a spacer disc mounted between the safety ring and the second spring support.

7. The r.p.m. regulator as defined in claim 6, wherein said control spring comprises a progressive compression spring.

8. The r.p.m. regulator as defined in claim 6, further comprising an intermediate spring support, wherein said control spring comprises a pair of coaxially disposed compression springs each having a different spring characteristic between which said intermediate spring support is disposed defining an opening through which said actuating rod extends.

9. The r.p.m. regulator as defined in claim 8, further comprising a further stop mounted on said actuating rod on that side of said intermediate spring support facing said first spring support with the compression spring disposed between said intermediate spring support and said second spring support biasing said intermediate spring support against said further stop.

* * * * *